US006260737B1

(12) United States Patent
Gruendeman

(10) Patent No.: US 6,260,737 B1
(45) Date of Patent: Jul. 17, 2001

(54) MANUAL VISCOUS LIQUID DISPENSING DEVICE

(75) Inventor: Peter Earl Gruendeman, Hopewell, NJ (US)

(73) Assignee: TAH Industries, Inc., Robbinsville, NJ (US)

( * ) Notice: Subject to any disclaimer, the term of this patent is extended or adjusted under 35 U.S.C. 154(b) by 0 days.

(21) Appl. No.: 09/474,198

(22) Filed: Dec. 29, 1999

(51) Int. Cl.[7] ..... B05C 17/01
(52) U.S. Cl. ..... 222/391; 222/571
(58) Field of Search ..... 222/391, 571, 222/326, 327

(56) References Cited

U.S. PATENT DOCUMENTS 1,672,421 * 6/1928 Negley ..... 222/391
2,115,591 * 4/1938 Sherbondy ..... 222/391
2,229,839 * 1/1941 Crewe ..... 222/391
2,768,768 * 10/1956 Cornell et al. ..... 222/391
3,141,583 * 7/1964 Mapel et al. ..... 222/391
4,826,053 * 5/1989 Keller ..... 222/340
5,992,694 * 11/1999 Keller ..... 222/137

* cited by examiner

*Primary Examiner*—Joseph A. Kaufman
*Assistant Examiner*—Patrick Buechner
(74) *Attorney, Agent, or Firm*—Davis & Bujold, P.L.L.C.

(57) ABSTRACT

A dispenser for manually dispensing pasty, semi-fluid products, from a cartridge, that must be applied with control and accuracy, incorporates an integral trigger and pawl plunger drive mechanism, in which the drive is activated by a trigger or actuator. A floating gripper is disposed on the plunger to release dispensing pressure in the cartridge to prevent drooling after the completion of dispensation.

6 Claims, 8 Drawing Sheets

MANUAL VISCOUS LIQUID DISPENSING DEVICE

FIELD OF THE INVENTION

This invention relates to product dispensing devices, and more particularly to devices for manually dispensing viscous liquids.

BACKGROUND OF THE INVENTION

Tools, containers, or devices for dispensing viscous liquid or semi-liquid products or materials are common and. widespread, and find use in many applications, both commercial (end consumer) and industrial. Such product dispensing tools or containers ideally allow the product to be applied in an accurate, mess-free, and waste-free manner.

Conventional small-volume dispensing packages for viscous liquids such as glues, sealants, greases and the like are frequently either disposable syringes or small cartridges. Common sizes range from 10 ml to 80 ml. The syringe-type dispensers commonly use a hand plunger to expel the material contained in a tube through a dispensing outlet or nozzle. Once all the material is dispensed, the entire syringe dispenser is simply thrown away.

In some cases, mechanical hand dispensers are used. In the past, these manual dispensers have been metal or metal/plastic and have incorporated numerous components, such as springs, levers and guides. Such mechanical dispensers are typically designed to be used in conjunction with sealed cartridges containing the product to be dispensed (sealing caulk, adhesive, lubricant, etc.) The cartridges are typically tubes having a sealed dispensing outlet (a conical tip for example) disposed on one end, with the other end being open for receiving a plunger mechanism or the like from the dispenser. Just inside the cartridge's open end is a slidably-sealed, axially-movable piston, disc, or the like. For use, the cartridge is placed in a retaining/dispensing section of the dispensing device, and the plunger is brought into contact with the piston. When a user desires to dispense product, the cartridge's dispensing outlet is unsealed (typically the closed tip of the dispensing outlet is cut off), and the plunger is forced against the piston through whatever actuation mechanism is employed by the dispenser (frequently a trigger/spring/rod mechanism.) This forces the piston axially down the tube and against the product, which in turn is dispensed through the dispensing outlet.

One such dispensing device is found in U.S. Pat. No. 4,509,662, which discloses a caulking gun.

Although the above disclosed caulking gun and similar dispensing devices are still frequently used, they are disadvantageous in many respects. For example, as mentioned above, they contain many separate moving and non-moving parts, and are therefore relatively difficult and expensive to manufacture and assemble. Also, with many designs, even after the desired amount of product is dispensed the plunger mechanism may still exert force against the cartridge piston, thus causing drooling (that is, further unwanted product to be expelled through the dispensing outlet.) This frequently results in wasted product, and may also result in a substantial mess if the user does not anticipate the additional dispensed product.

SUMMARY OF THE INVENTION

Wherefore, it is an object of the present invention to overcome the aforementioned problems and drawbacks associated with the prior art designs.

Another object of the invention is to provide a low cost ergonomic dispenser with a reduced number of parts. As shown below, acceptable function can be achieved with as little as one multi-function drive component which incorporates the functions of a trigger, a pawl, a feature to release the pawl and required return springs.

Another object of the present invention is to provide a low cost dispenser with a reduced number of parts that still has a long useful lifespan.

The presently disclosed invention is a new mechanism for the operation of a manual liquid product dispenser or caulking gun. Generally, the dispenser is intended for dispensing pasty, viscous, semi-fluid products that must be applied with control and accuracy. The device incorporates a unique integral trigger and pawl drive mechanism, in which the drive is activated by a trigger or other actuator. A product dispensing cartridge, syringe or other product container is attached to the front of the dispenser via a cartridge holding mechanism. As the trigger is depressed, the pawl drive mechanism engages and advances a plunger into the product container, contacting and advancing a piston within the cartridge which in turn advances and expels product from a cartridge dispensing outlet. At the completion of the stroke, the trigger is released and the drive mechanism disengages the plunger, the disengagement interaction between the drive mechanism and the plunger causing the latter to move rearwards. A floating gripper, disposed on the plunger, limits the amount of this rearward movement, the effect of which is to decompress the product cartridge and thus prevent drooling after the completion of dispensation.

BRIEF DESCRIPTION OF THE DRAWINGS

The invention will now be described, by way of example, with reference to the accompanying drawings in which.

DESCRIPTION OF THE PREFERRED EMBODIMENTS

Turning now to FIGS. 1A–1E, a detailed description concerning a first embodiment of the present invention will now be provided. This design is most suitable for applications requiring the minimum of cost, for example, single use applicators.

Figure 1A:
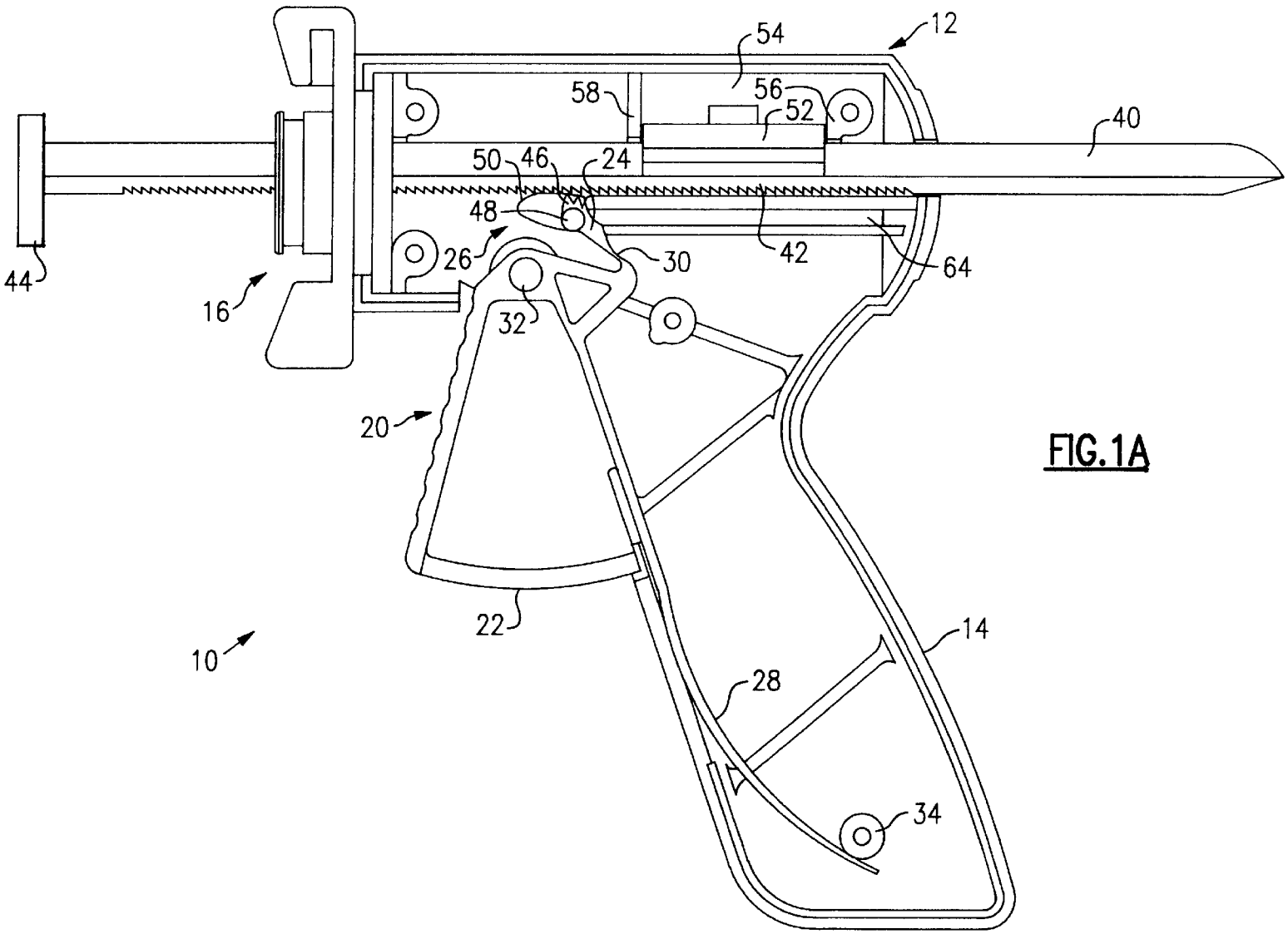
FIG. 1A is a diagrammatic elevation of a first embodiment of the dispensing device of the present invention, partially in cross-section.

In FIG. 1A, a first embodiment of a liquid product dispenser 10 comprises a generally cylindrical hollow body 12 having a handle extension 14 and a product cartridge holding mechanism 16. Furthermore, the dispenser 10 has a multi-function drive component 20 incorporating the functions of a trigger 22, a pawl 24, a pawl release feature 26, a trigger return torsion spring 28, and a pawl bias spring 30. The multi-function drive component 20 is an integral, unitary construct, preferably made from a resilient, semi-flexible material such as plastic.

The drive component 20 is pivotally connected to the dispenser body 12 via a trigger pin 32. If the pin 32 is integral with the body 12, as is preferable, then the drive component 20 is provided with a complementary shaped hole for engaging the pin. The trigger return spring 28 is biased in place via a spring stop 34 integral with the handle 14. A plunger 40 having an underside provided with a rack (a plurality of rachet teeth) 42 is supported by and extends axially through the body 12, with a plunger head 44, integral with the plunger 40, disposed on the end of the dispenser proximate the cartridge holding mechanism 16. The plunger 40 may be further supported by a guide 64 integral with and internal of the body.

As mentioned above, the multi-function drive component 20 includes the integral pawl 24, which is connected to the remainder of the drive component 20 via the pawl bias spring 30. The pawl bias spring 30 is simply a non-rigid, resilient thin portion in the plastic material of the drive component 20 between the pawl 24 and the trigger 22. The pawl bias spring 30 biases the pawl 24 against the underside of the plunger 40, and causes a plurality of pawl teeth 46 disposed on the pawl to engage the rack 42 upon trigger actuation.

As shown in FIG. 1A, when the drive component 20 is unactuated, that is, when the dispensing device 10 is not in use, the pawl 24 does not engage the rack 42, and the pawl bias spring 30 is relaxed, or un-flexed. In this situation, since the pawl 24 does not engage the rack 42 when the device 10 is unactuated, it is theoretically not necessary to provide a pawl release feature 26. However, the pawl must remain close to the rack even when unactuated in order to minimize the required amount of trigger throw and maximize dispensing control and efficiency. Therefore, a pawl release feature should be provided. This is because the pawl size may vary due to manufacturing tolerances, resulting in pawls that might interfere with the rack/plunger even when the device is unactuated. Variation in pawl size might also result from heat or steam sterilization required for some medical applications.

For assembly, the hollow body 12 is preferably manufactured as two separate, matching halves. The cartridge holding mechanism 16, with the plunger 40 already inserted therethrough, is placed in the first half. Then the drive component 20 is placed over the pin 32 while the pawl 24 is depressed against the action of the pawl bias spring 30 (if necessary.) Then, the second half of the hollow body is brought into contact with the first half, and the two are attached via fastening means such as screws or rivets. Such assembly/manufacturing details are known to those with skill in the manufacturing arts, and therefore further detail of the same is not described herein.

In the embodiment of FIGS. 1A–1E, the pawl release feature 26 is in the form of a cylindrical pin or other shaped extension 48 integral with and extending laterally from the pawl 24, and passing through the exterior of the dispenser via a slot 50 provided in the dispenser body 12. An additional slot and extension may be provided on the other side of the body 12.

Although the pawl 24 will ideally completely disengage from the rack 42 when the device is unactuated, the slot 50 may be configured to further act as a pawl guide, helping to disengage the pawl when the trigger 22 is released. For example, the front portion of the slot 50 could be horizontal (as shown in FIGS. 1A–1E), and the rear portion of the slot could slope downwards. Upon the release of the trigger, the pin extension 48 would eventually strike and slide down the top of the downwardly sloping slot, and the pawl would be drawn down and out of engagement or interference with the rack.

For use, before a product cartridge is attached to the dispenser via the cartridge holding mechanism 16, the plunger 40 must be retracted. With the pawl 24 disengaged from the plunger 40 (either by ensuring the drive component 20 is in its unactuated state or by using the pawl release feature 26, as necessary, and as discussed above), the plunger is manually pulled back until the plunger head 44 is proximate the cartridge holding mechanism 16. Then, the product cartridge (not shown) is attached. Upon actuation of the trigger 22, the pawl 24 is moved into engagement with the rack 42 and the plunger 40 is advanced. When the plunger head contacts a fluid piston within the cartridge, the fluid is pressurized inside the cartridge and expelled out a product outlet provided in the cartridge (in the form of a nozzle, for example.) At the completion of the dispensing stroke, the trigger is released. The pawl slips back over the rack in preparation for engaging new teeth for the next dispensing cycle.

As mentioned previously, it is advantageous to provide a pressure relief feature for reducing or eliminating drooling. Upon the completion of dispensing, the trigger is released and returns to the rest position by the integral trigger return torsion spring 28. The force of the pawl teeth 46 in resilient contact with the rack 42 tends to drag the plunger 40 rearward as the pawl teeth slide over the rack. This is a result of the complementary, rachet-like shape of the rack and pawl teeth.

Figure 1B:
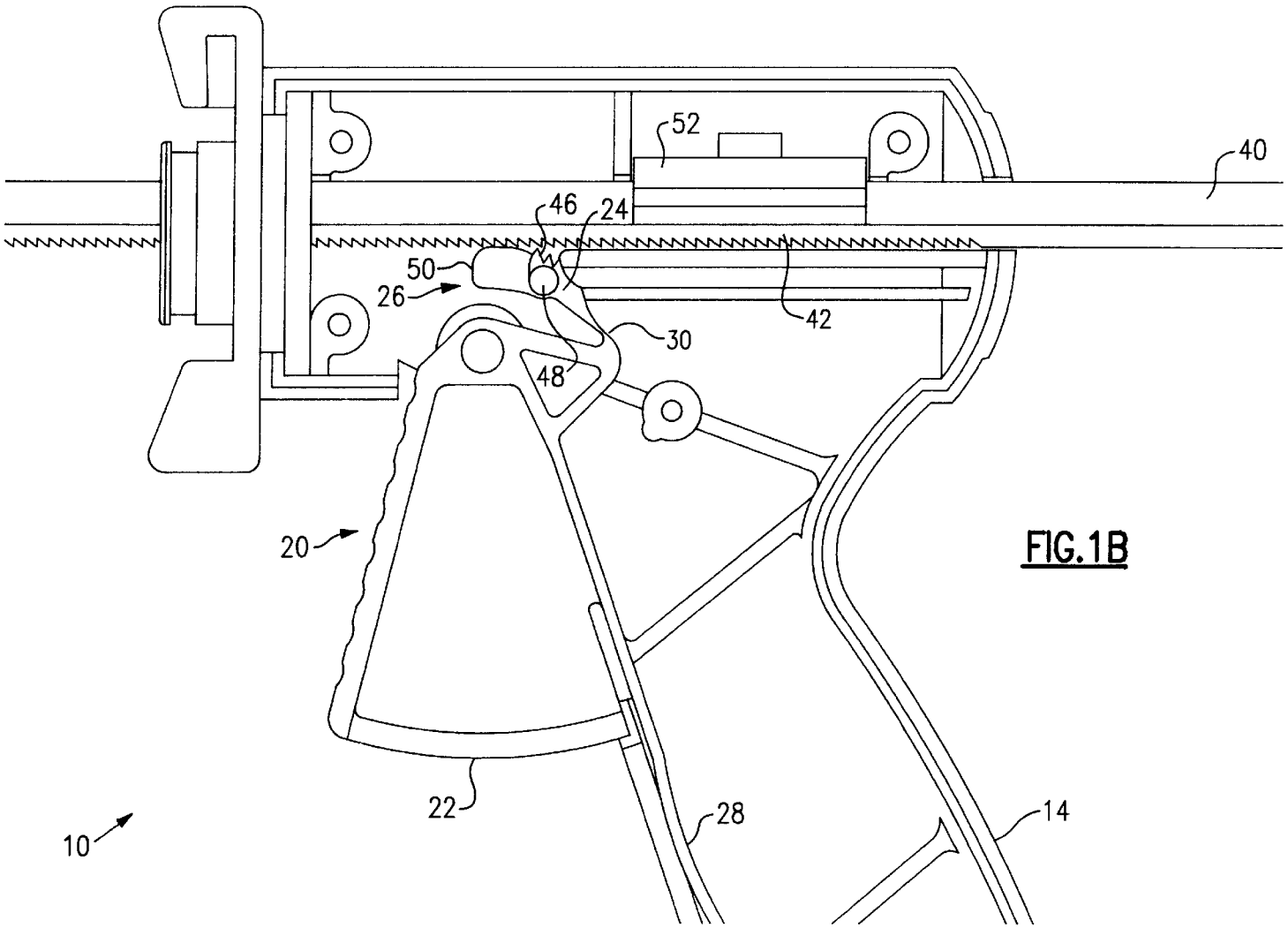
FIG. 1B is a detailed view of the dispensing device in an unactuated state.

A complete dispensing cycle is shown in FIGS. 1B–1E. In FIG. 1B, a user has not yet actuated the dispensing device 10. The pawl 24 has not yet engaged the rack 42, and both the pawl bias spring 30 and the trigger return spring 28 are in a relaxed state.

Figure 1C:
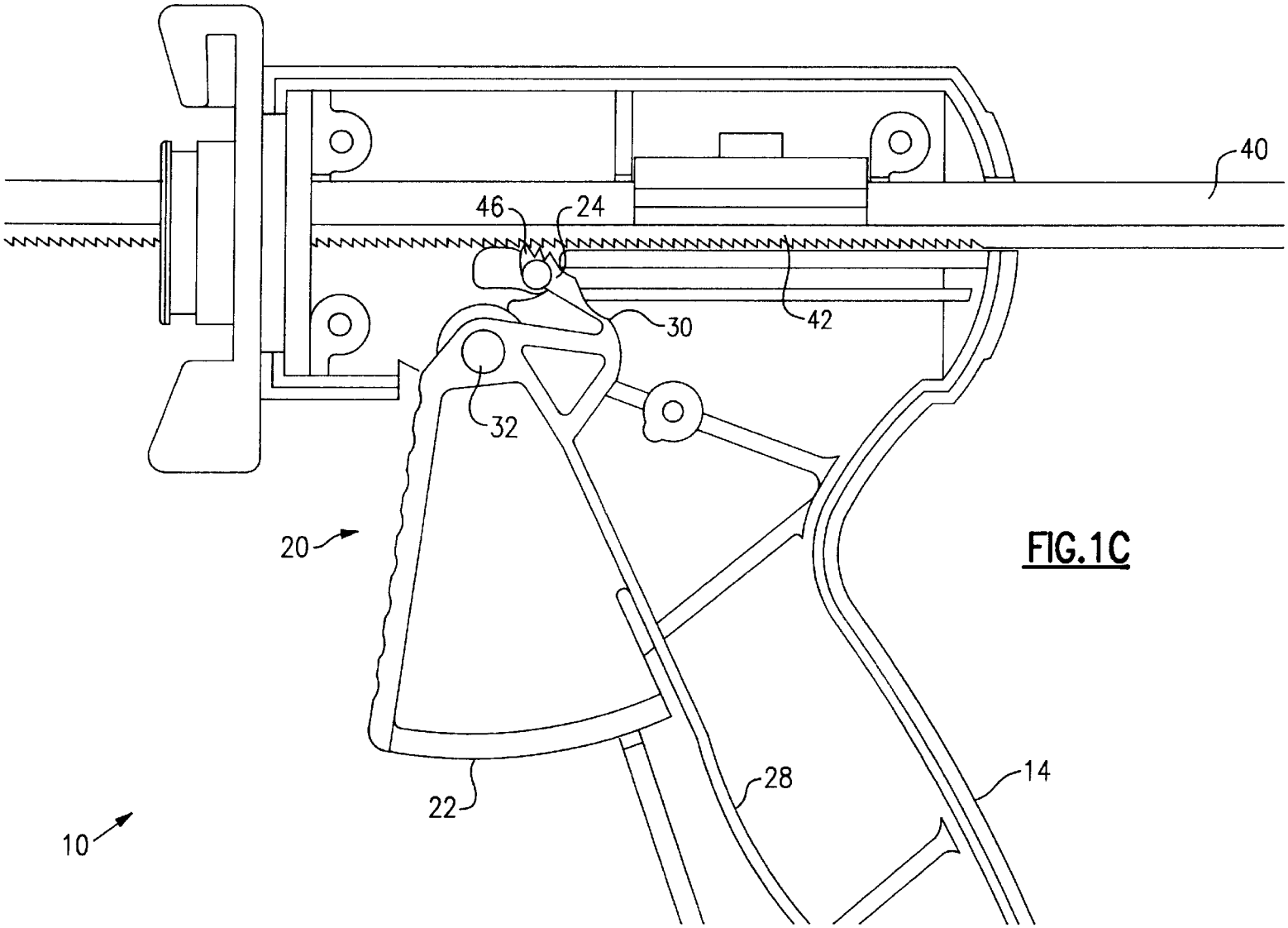
FIG. 1C is a detailed view of the dispensing device upon initial depression of a trigger.

In FIG. 1C, the user has just begun to actuate the drive component 20 by depressing the trigger 22, which thereby pivots about the trigger pin 32 counterclockwise. The pawl 24 rotates up and forward, and the pawl teeth 46 begin to engage the rack 42.

Figure 1D:
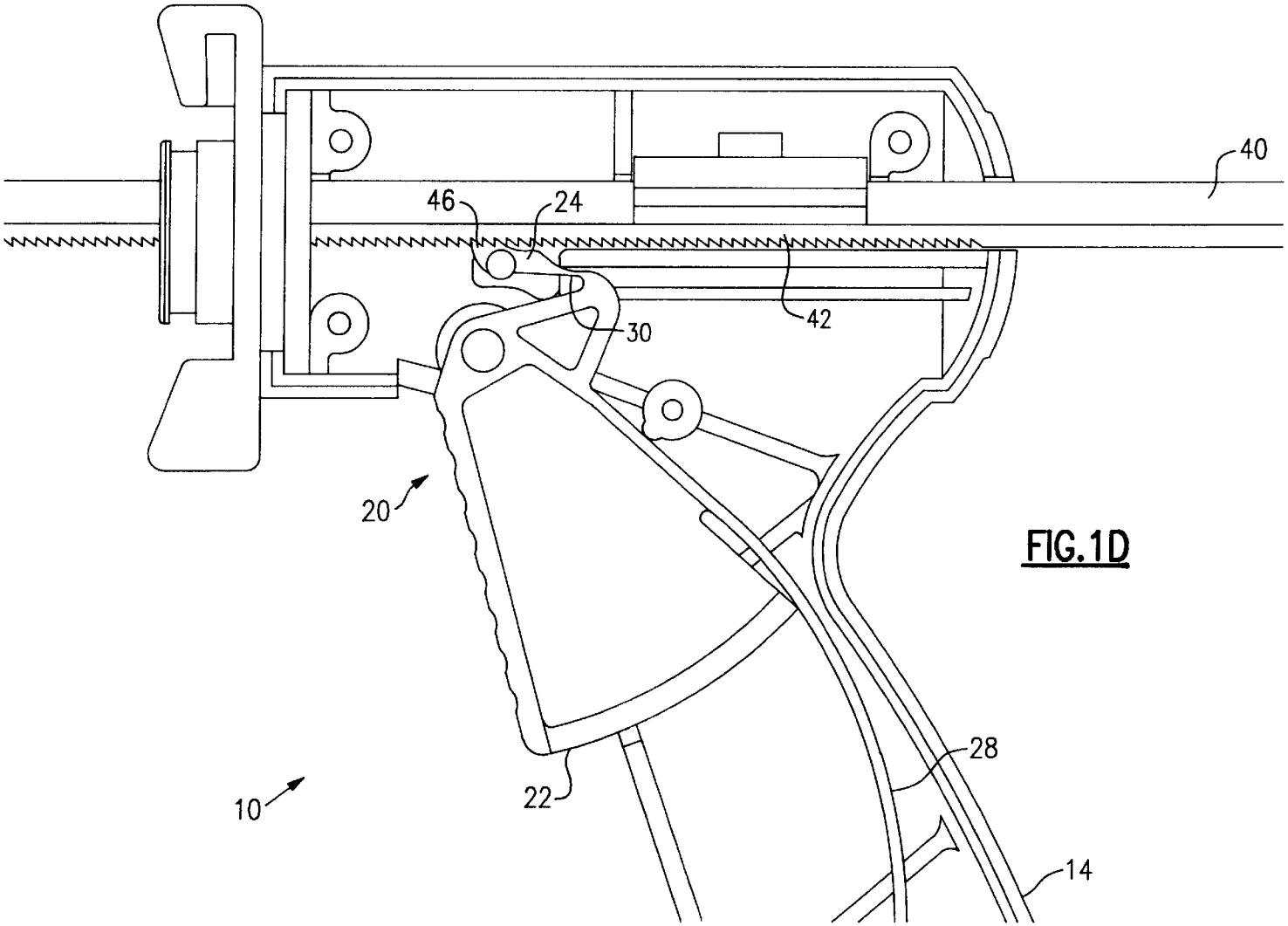
FIG. 1D is a detailed view of the dispensing device upon full depression of the trigger.

In FIG. 1D, the user has completely depressed the trigger 22. All the pawl teeth 46 have engaged the rack 42, and the plunger 40 has thereby moved forward. Meanwhile, the pawl bias spring 30 has flexed downwards to allow and ensure that the pawl 24 fully engages the rack 42. Without the pawl bias spring 30, the pawl 24 would not be able to fully engage the rack 42, and the dispensing cycle would be much shorter (i.e. the user would have to depress the trigger many times to dispense a suitable amount of product.) Also, the action of depressing the trigger 22 has fully flexed the trigger return spring 28.

Figure 1E:
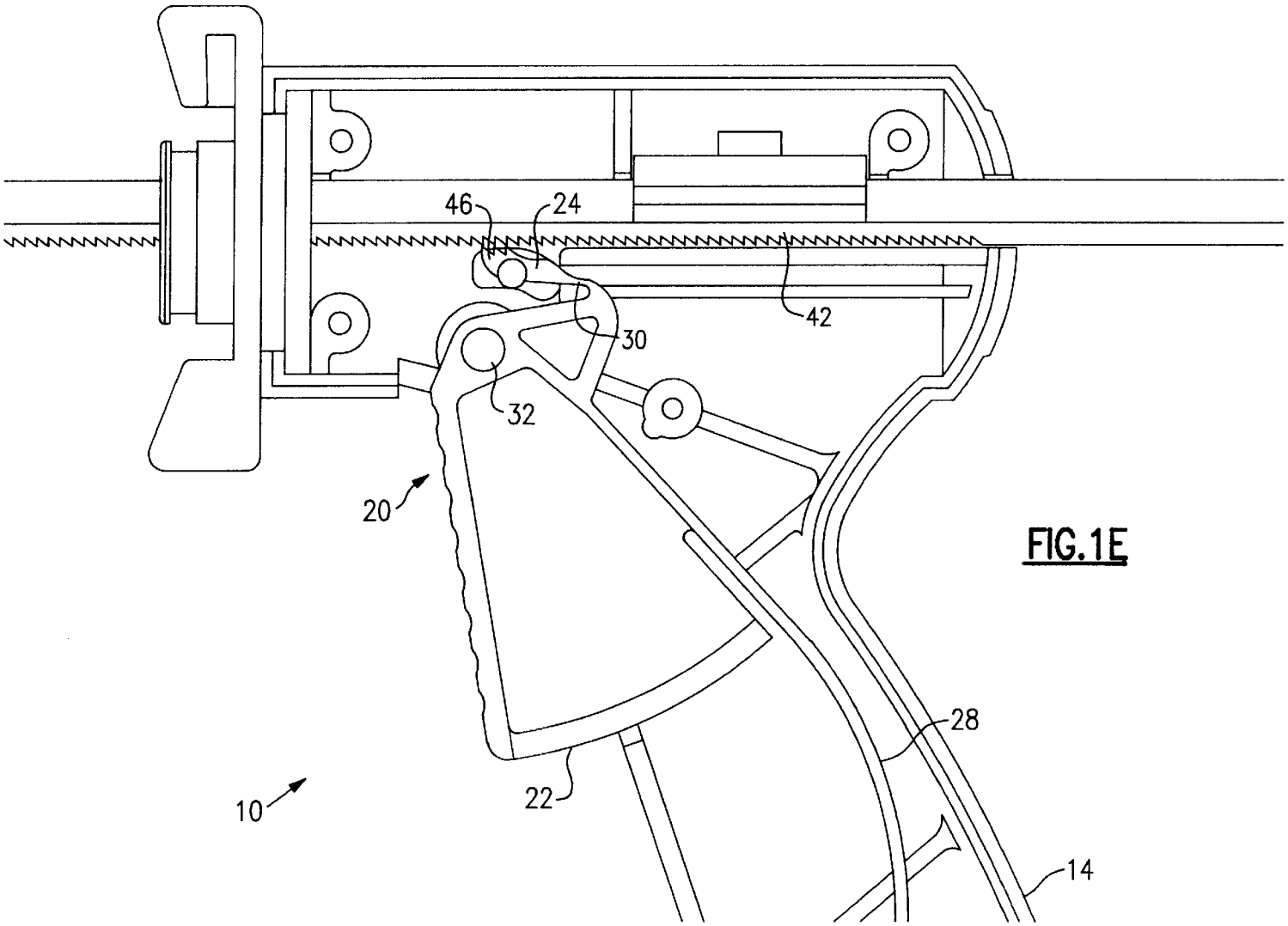
FIG. 1E is a detailed view of the dispensing device upon initial release of the trigger.

Finally, in FIG. 1E the user has begun to release the trigger 22, with the drive mechanism 20 pivoting clockwise about the trigger pin 32 under the action of the flexed trigger return spring 28. The pawl teeth 46 slide rearwards and over the rack 42 as described above, and eventually disengage from the rack 42. Upon complete release of the trigger, the drive component 20 and the pawl 24 return back to their position as shown in FIG. 1B.

As mentioned, some rearwards motion of the plunger is desirable to prevent the cartridge from remaining under pressure and drooling. However, too much of this rearward motion will result in unacceptable dispensation resulting from reduced dispensing efficiency or no dispensing at all. In order to limit rearwards movement, a floating gripper 52 is placed onto the plunger to limit its rearward motion.

The floating gripper 52 is a friction device dimensioned to slidably engage the top guide of the plunger 40. The gripper 52 is located within a pocket 54 inside the dispenser body 12. The pocket 54, defined by a rear pocket wall 56 and a forward pocket wall 58, is slightly longer than the gripper. When the trigger 22 is depressed and the plunger 40 moves forward, the gripper 52, in friction contact with the plunger, moves along with the plunger until the gripper hits the forward wall 58 of the pocket. At this point the force exerted by the user upon the trigger is sufficient to overcome the friction force of the gripper, and the plunger slides through the gripper.

When the trigger is released, the plunger moves rearward via the effect of the pawl teeth sliding over the rack, as described above. The gripper travels rearward along with the plunger for about 0.040 to 0.080 inches, which is the total distance between the gripper and the pocket walls 56, 58. Once the gripper hits the rear wall 56 the entirety of the gripper and plunger stops. This is because the friction force of the gripper is greater (by design) than the rearwards force exerted by the sliding pawl. This slight rearward motion of the plunger allows rapid decompression of the fluid product within the cartridge.

The floating gripper 52 may be fashioned in any manner, as long as it provides a slidable friction contact with the plunger 40. The friction force of the floating gripper on the plunger must be such that it is greater than the rearwards force of the pawl sliding over the rack and less than a reasonable user actuation force. A typical suitable friction force applied by the floating gripper is 1 to 2 lbs.

As an alternative to the floating gripper, a friction feature in the form of integrally molded fingers or ridges can be incorporated into the body of the dispenser. This would result in a further reduction in the number of components and therefore a reduction in assembly costs. However, this would increase the possibility of drooling with some low viscosity products.

Figure 2:
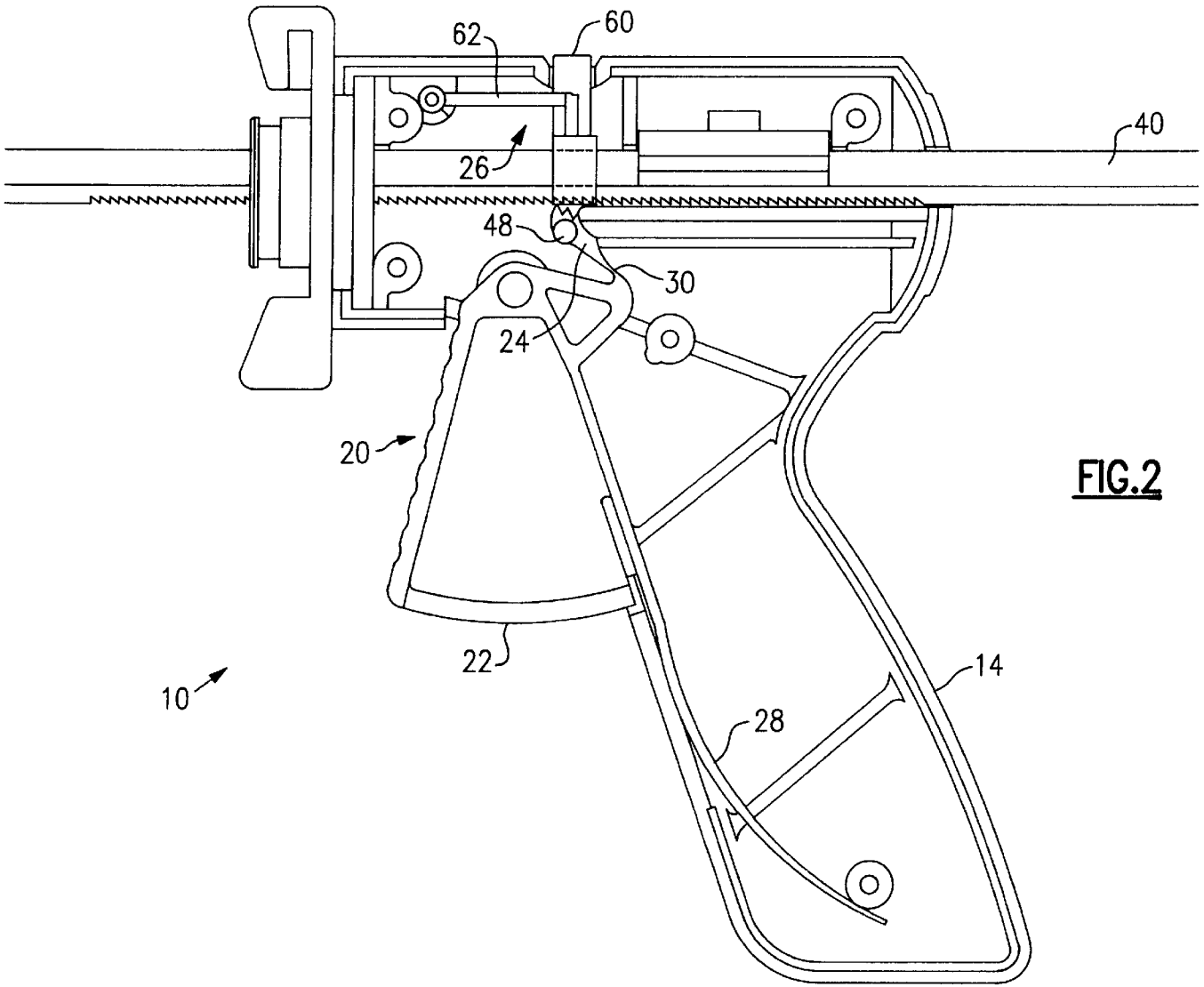
FIG. 2 is a diagrammatic elevation of a second embodiment of the present invention, partially in cross-section.
Figure 3:
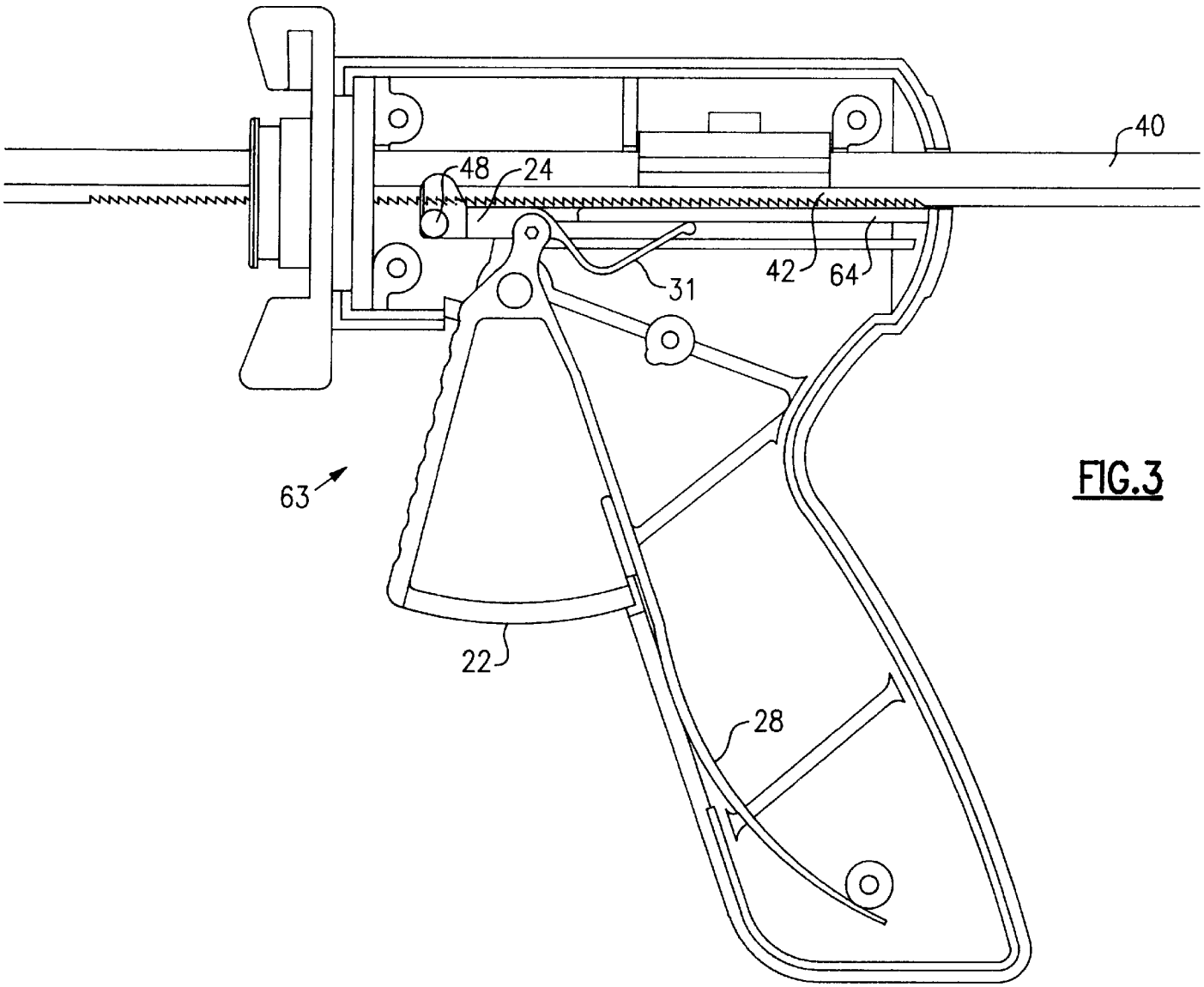
FIG. 3 is a diagrammatic elevation of a third embodiment of the present invention, partially in cross-section.
Figure 4:
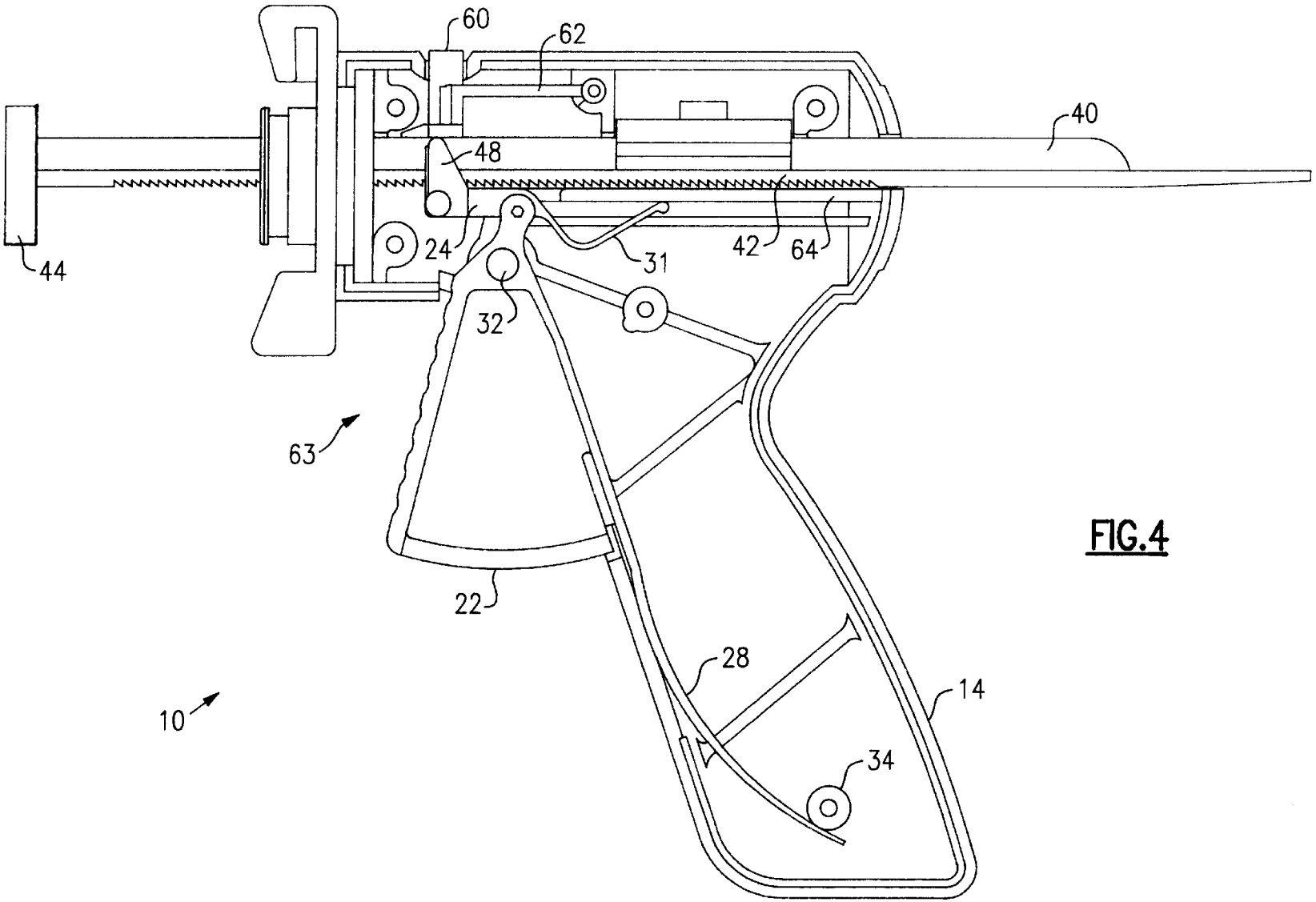
FIG. 4 is a diagrammatic elevation of a fourth embodiment of the present invention, partially in cross-section.

FIGS. 2–4 show embodiments of the present invention using two and three drive/release components, instead of the single multi-function drive component 20 of the embodiment of FIGS. 1A–1E. These embodiments offer either more intuitive operation and/or longer life before device failure.

The device shown in FIG. 2 uses the same multi-function drive component 20 as the device in FIGS. 1A–1E. However, instead of the pawl extension 48 extending through a slot provided in the body 12, the pawl extension remains internal to the dispensing device, and no slot is provided. Here, the pawl release feature 26 comprises an external pawl release button 60 extending through and located at the top of the device body 12. The button 60 is held in place via a button bias spring 62. The button, extending down through the device on one or both sides of the plunger 40, is positioned above the pawl extension 48. When the button is actuated by a user in order to disengage the pawl, the force of the button bias spring 62 is overcome, and the button comes into contact with the pawl extension. This pushes the pawl 24 down, against the force exerted by the pawl bias spring 30, thereby spacing the pawl teeth from the rack and allowing the user to freely move the plunger.

Another embodiment having two drive/release components is shown in FIG. 3, where the pawl 24 is separate from the trigger 22. In this embodiment, the pawl 24 is pivotally coupled to an integral trigger mechanism 63 comprising a trigger 22 integral with a trigger return spring 28. The pawl 24 is maintained in place by a pawl bias torsion spring 31 in contact with the guide 64. In this instance, the pawl bias torsion spring 31 is a thin, resilient, flexible extension of the pawl 24, and biases the pawl 24 against the rack 42 even when the trigger mechanism 63 is unactuated. During product dispensation, the pawl bias torsion spring 31 moves with the pawl and is guided and supported by the spring guide 64, for movement with the pawl, at an end remote from the pawl. Releasing the pawl from the rack 42 is accomplished by exerting force downwards on the pawl extension 48, which is preferably two extension pins integral to and extending laterally away from the pawl and through two slots 50 (not shown) provided in the device on either side of the body 12 (as was shown in the embodiment of FIG. 1.) The advantages of this device include a greater life expectancy under higher loads (due to the non-rotating manner in which the pawl teeth contact the rack), and a low manufacturing cost.

A final embodiment using three drive/release components is shown in FIG. 4, which incorporates the separate pawl of the device of FIG. 3 and the push-button pawl release feature similar to that of the device of FIG. 2. This device also offers substantial reductions in cost while requiring no compromises in ease of use or life expectancy. Note that in this embodiment the pawl extension 48 is not a lateral, pin-like extension, but rather an integral feature that extends up and over at least one side of the plunger 40. Also, the pawl bias torsion spring 31 functions in a manner similar to that as described above for the embodiment of FIG. 3.

An important ergonomic consideration in the design of the present invention involves the finger forces required to expel the fluid. Generally, products to be dispensed are pasty fluids, such as caulk, solder paste, adhesives, or lubricants. Usually these materials require dispensation with accuracy into either small drops or beads. To that end, a mechanical advantage ranging from 6–12:1 is preferred. The mechanical advantage is defined as the distance traveled by the trigger divided by the advance of the plunger. Within this range the operator has excellent control of the dispensing operation. With less viscous fluids these guidelines will differ, with the mechanical advantage generally being reduced for less viscous fluids.

In the present invention, the plunger is driven forward by the pawl teeth engaging and pushing the rack. Multiple fine teeth are used to transmit the required force to the plunger since the forces can be high and a small tooth spacing is thus desirable. Larger tooth spacing requires unacceptably low mechanical advantage, or results in no advancement of the plunger with successive pulls of the trigger.

The device of the present invention can be provided with any number of cartridge holding mechanisms 16. The mechanism illustrated in the Figures is a bayonet holder. The cartridge, which would have ear flanges, would be pushed onto a centering hub and then twisted 90 degrees. The centering hub would have an o-ring or other resilient centering feature to allow for proper centering of the cartridge. The cartridge ears would twist into place behind the bayonet lugs, and would thus be securely locked into place. Different diameter cartridges would require different bayonet holders.

Alternatively, drop-in designs could be used (an open tube with cup ends, for example), or a holding mechanism could be provided that holds cartridges having lugs or threads, externally or internally.

Although the present invention has been illustrated as having integral plastic torsion bias and return springs, one of ordinary skill in the art will appreciate that other application specific spring types could be used without departing from the spirit and scope of the invention. For example, steam or heat sterilization (as required for some medical applications) may result in the plastic bias and return springs annealing.

This could possibly destroy or reduce these plastic spring's effectiveness. To overcome this problem in applications requiring steam sterilization, metal torsion springs could be provided. For example, a long, thin piece of semi-flexible metal could be attached to the trigger 22 in place of the integral plastic trigger return spring 28, either by inserting the metal spring into the plastic trigger while it is still molten, or by providing a small slot in the trigger into which the metal spring could be inserted. Other, similar metal springs could replace the pawl bias springs 30, 31. Although these metal springs would increase the cost of the dispensing device, the overall cost would still be low because of the relative design simplicity and ease of assembly.

Since certain changes may be made in the above described dispensing device, without departing from the spirit and scope of the invention herein involved, it is intended that all of the subject matter of the above description or shown in the accompanying drawings shall be interpreted merely as examples illustrating the inventive concept herein and shall not be construed as limiting the invention. For example, the dispenser of the present invention could readily be adapted to a two plunger head design for dispensing two-part products such as epoxy from parallel tube two-part packages.

TABLE OF ELEMENTS

| | |
|---|---|
| 10 | dispensing device, generally |
| 12 | hollow body |
| 14 | handle |
| 16 | cartridge holding mechanism |
| 20 | multi-function drive component |
| 22 | trigger |
| 24 | pawl |
| 26 | pawl release feature, generally |
| 28 | trigger return spring |
| 30 | pawl bias torsion spring |
| 31 | pawl bias spring (non-integral pawl design) |
| 32 | trigger pin |
| 34 | spring stop |
| 40 | plunger |
| 42 | rack |
| 44 | plunger head |
| 46 | pawl teeth |
| 48 | pawl extension |
| 50 | slot (in hollow body) |
| 52 | floating gripper |
| 54 | picket (in hollow body) |
| 56 | rear pocket wall |
| 58 | forward pocket wall |
| 60 | pawl release button |
| 62 | button bias spring |
| 63 | integral trigger mechanism (pawl separate) |
| 64 | pawl bias spring guide |

Wherefore, I claim:

1. A product dispensing device comprising:

a hollow body having a first end and a second end;

a product holding mechanism at the first end;

a plunger defining a rack, supported by and extending through the product holding mechanism and the hollow body from the first end to the second end; and a drive mechanism, pivotally coupled to the hollow body, including an integral trigger, trigger return spring, and pawl connected to the trigger via an intergral pawl bias spring for bringing the pawl into contact with the plunger, the pawl having a set of pawl teeth shaped to complement the rack, whereby when a user actuates the trigger the pawl teeth move the plunger forward toward the first end of the body, and when the user releases the trigger the pawl teeth slide back over the rack moving the plunger rearwards and allowing the user to further advance the plunger upon subsequent actuation of the trigger; and wherein the hollow body further includes a pocket defined by a forward pocket wall and a rear pocket wall, and a floating gripper, disposed within and shorter than the pocket, is slidably frictionally coupled to the plunger, the friction force of the floating gripper being greater than the rearwards force on the plunger caused by the rearwardly sliding pawl teeth, whereby when the user actuates the trigger to advance the plunger the floating gripper contacts the forward pocket wall and the plunger slides through the floating gripper, and when the trigger is released, the plunger, acting upon the force of the sliding pawl teeth, moves rearwards until the floating gripper contacts the rear pocket wall.

2. The product dispensing device of claim 1 wherein the dispensing device further comprises a pawl release feature connected to at least one of the body and the pawl for allowing a user to disengage the pawl from the plunger.

3. The product dispensing device of claim 1 wherein when the drive mechanism is unactuated the pawl teeth do not engage the rack.

4. A product dispensing device comprising:

a hollow body having a first end and a second end;

a product holding mechanism disposed proximate the first end;

a plunger, defining a rack, supported by and extending through the product holding mechanism and the hollow body from the first end to the second end;

a trigger mechanism pivotally coupled to the hollow body, the trigger mechanism comprising an integral trigger and trigger return spring;

a pawl integral with a pawl bias spring, the pawl being pivotally connected to the trigger, the pawl defining a set of pawl teeth shaped to complement the rack, and the pawl bias spring contacting a guide integral to the body and biasing the pawl against the plunger; and a pawl release feature connected to at least one of the body and the pawl for allowing a user to disengage the pawl from the plunger, whereby when the user actuates the trigger the pawl teeth move the plunger forward toward the first end of the body, and when the user releases the trigger the pawl teeth slide back over the rack moving the plunger rearwards and allowing the user to further advance the plunger upon subsequent actuation of the trigger.

5. The product dispensing device of claim 4 wherein the hollow body further includes a pocket defined by a forward pocket wall and a rear pocket wall, and a floating gripper, disposed within and shorter than the pocket, is slidably frictionally coupled to the plunger, the friction force of the floating gripper being greater than the rearwards force on the plunger caused by the rearwardly sliding pawl teeth, whereby when the user actuates the trigger to advance the plunger the floating gripper contacts the forward pocket wall and the plunger slides through the floating gripper, and when the trigger is released, the plunger, acting upon the force of the sliding pawl teeth, moves rearwards until the floating gripper contacts the rear pocket wall.

6. The product dispensing device of claim 4 wherein the pawl teeth always remain engaged to the rack.

* * * * *